US005450709A

United States Patent [19]

Steding

[11] Patent Number: 5,450,709

[45] Date of Patent: Sep. 19, 1995

[54] STATIONARY PALLET STRETCH WRAPPING DEVICE HAVING IMPROVED METHOD AND APPARATUS FOR GRIPPING AND CUTTING OR WRAPPING FILM

[75] Inventor: Kurt L. Steding, Pittsburgh, Pa.

[73] Assignee: SDS, Inc., Bridgeville, Pa.

[21] Appl. No.: 145,454

[22] Filed: Oct. 29, 1993

[51] Int. Cl.[6] ..... B65B 11/02

[52] U.S. Cl. ..... 53/465; 53/210; 53/218; 53/399; 53/556; 53/588

[58] Field of Search ..... 53/465, 461, 463, 588, 53/589, 587, 210, 214, 211, 218, 399, 556, 441

[56] References Cited

U.S. PATENT DOCUMENTS

| | | | |
|---|---|---|---|
| 3,930,442 | 1/1976 | Buttner | 100/18 |
| 4,067,174 | 1/1978 | Goldstein | 53/210 X |
| 4,077,179 | 3/1978 | Lancaster et al. | 53/465 X |
| 4,109,445 | 8/1978 | Shulman | 53/210 X |
| 4,232,501 | 11/1980 | Stackhouse | 53/465 X |
| 4,282,700 | 8/1981 | Goldstein | 53/556 |
| 4,418,510 | 12/1983 | Lancaster, III et al. | 53/465 X |
| 4,498,276 | 2/1985 | Reed | 53/588 |
| 4,545,182 | 10/1985 | McDowell, Jr. | 53/556 |
| 4,616,474 | 10/1986 | Morley et al. | 53/556 |
| 4,693,060 | 9/1987 | Born | 53/588 |
| 4,722,170 | 2/1988 | Ball et al. | 53/556 |
| 4,747,252 | 5/1988 | Kapke | 53/399 |
| 4,756,143 | 7/1988 | Lancaster | 53/556 |
| 4,761,934 | 8/1988 | Lancaster | 53/399 |
| 4,905,448 | 3/1990 | Plitt | 53/399 |
| 4,936,080 | 6/1990 | Haloila | 53/465 |
| 4,993,209 | 2/1991 | Haloila | 53/399 |
| 4,995,224 | 2/1991 | Yourgalite et al. | 53/588 X |
| 5,410,795 | 8/1992 | Steding | 53/168 |

OTHER PUBLICATIONS

Infrapak Sidewinder brochure Apr., 1983.
Infrapak E Z Wrapper brochure Oct., 1981.
Lan-wrapper H-Series brochure.
Four (4) Lan-wrapper V-Series brochures.
T-Wrapper brochure.
Infrapak Spider brochure, Jul., 1981.

*Primary Examiner*—James F. Coan
*Attorney, Agent, or Firm*—Barry I. Friedman; Dickie, McCamey & Chilcote

[57] ABSTRACT

A fully automatic stationary wrapping mechanism is utilized in conjunction with an upstream palletizing device and a downstream distribution system. An inbound zone accepts palletized materials and selectively passes them along to a wrap zone. An outbound zone provides a direct link with the wrapping device in any downstream distribution conveyor system. The apparatus provides a relatively short, straight pathway from the point of construction of the loaded pallet through the wrapping station to the outbound conveyor. An improved film gripping device is provided as an elongated arm, extendable from a home position outside the wrapping area to within the wrap zone in order to grip the film, and such that the specific location of the free end of film is not particularly critical. Following the wrapping operation, a length of fresh, unstretched film is extended, and an improved cutting device utilizes a heating element enclosed within a housing having an opening adjacent the heating element to sever the film at this point. The film is drawn across the housing and is severed by localized melting adjacent the location of the opening in the housing, providing a clean, predictable, unstretched termination to the film while preventing direct contact of the melting film material with the heating element itself.

68 Claims, 6 Drawing Sheets

STATIONARY PALLET STRETCH WRAPPING DEVICE HAVING IMPROVED METHOD AND APPARATUS FOR GRIPPING AND CUTTING OR WRAPPING FILM

BACKGROUND OF THE INVENTION

1. Field of the Invention

The present invention relates to an apparatus for securing boxes of merchandise to a pallet through the use of a continuous stretch wrap layer applied to the exterior of the loaded pallet. The invention also relates to gripping and cutting mechanisms utilized in conjunction with said mechanism intended to increase the speed of said operations. More specifically, the invention relates to a single station wrapping mechanism utilized in association with a conveyor system having a rotary arm wrapping mechanism which utilizes particularized gripping and termination mechanisms and a method for use thereof which allows for a more stable and efficient gripping of wrapping film in preparation to a wrapping cycle and more precise cutting of said film subsequent to said wrapping cycle and which is adapted to leave said film in a condition for more efficient gripping during the next wrapping cycle.

2. Description of the Prior Art

Modern transportation methods of goods involve the packaging of discreet manufactured units within cardboard enclosures. These cardboard enclosures are frequently stacked on a wooden pallet in standard lot sizes for easier transportation in large quantities. Pallets are adapted to be easily located and transported through the use of a forklift and furthermore may be transported along a conveyor. Because the palleted merchandise must be moved by mechanical means often involving stopping, starting and changing directions, the palleted load must be secured upon the pallet. The first method of securing the load is to stack the objects thereon in an interlocking pattern which maximizes the stability of the stacked load. The weight and location of the goods are evenly distributed on the pallet so that minimal shifting occurs during transportation. Furthermore, the pallet pattern, as such stacking practices are called, is designed to prevent collapse of materials in the lower portion of the stack.

An additional method for securing "palletized" materials to the pallet is to enclose the palletized stack in a plastic wrap or film. This is especially useful when all of the palletized materials are not of identical shape and size. A plastic stretch wrap is applied to the exterior of the pallet stack and continuously wrapped around the exterior of the stack to effectively form a solid cube of materials. Due to the weight and size of the now unitary structure mounted on the pallet, shifting is less likely to occur during transportation of the palletized merchandise. In order to apply the stretchable plastic wrap to the pallet, the wrap is prestretched to a specified limit, applied to the palletized stack of merchandise with certain force, and allowed to shrink back against the exterior of the palletized stack forming a tight enclosure around the stacked materials. The physical wrapping of the pallet stack usually involves the helical progression of wrap from top to bottom, or vice versa, in a repeated fashion, until the stack has been adequately secured. Care must be taken that the wrap is applied with the proper amount of prestretch and tension, commonly known as force to the load, otherwise the stack may become unstable or the contents may be crushed by the force of the stretched film.

A number of devices have been proposed in the prior art to perform this wrapping function. A representative sample of these devices are disclosed in Ball, et al., U.S. Pat. No. 4,772,170, issued Feb. 2, 1988; Salzsauler, U.S. Pat. No. 4,934,132, issued Jun. 19, 1990; and Haloila, U.S. Pat. No. 4,993,209, issued Feb. 19, 1991. Each of the references discloses a device which generally comprises a support stand having a rotating swing arm mounted thereon and a swing arm having a carriage at the end thereof which contains the plastic wrap. The Haloila reference utilizes a fixed circular track surrounding the pallet having a carriage mounted thereupon to achieve the same objective. The carriage containing the plastic wrap is continuously rotated in a circular fashion above the palletized stack which is helically encased in at least one layer of film while the carriage rotates thereabout while moving vertically along its support column.

Buettner, U.S. Pat. No. 3,930,442, issued Jan. 6, 1976, Schulman, U.S. Pat. No. 4,109,445, issued Aug. 29, 1978, and Haloila, U.S. Pat. No. 4,936,080, issued Jun. 26, 1990, all disclose similar wrapping devices as those previously described, however each of these three references further discloses the use of a conveyor to transport the palletized goods to the wrapping station.

Furthermore, Lantech, Inc., of Louisville, Kentucky, provides automatic stretch-wrapping devices in its H- and V-Series wrappers which utilize a rotary turntable to displace the palleted materials while the wrapping device remains stationary. These devices, however, utilize an automatic sequencing process which controls the entire wrapping procedure from the entry to the exit of the palletized materials through the wrapping zone.

In practice, the prior art devices are limited in terms of throughput by several factors. One of the many factors affecting the throughput of the device is the necessity to automatically begin and end each wrap cycle without the need for human intervention. Furthermore, the device must smoothly transition from one wrap cycle to the next without human intervention as well. This means the device must move the palletized materials into the wrap zone from a first staging zone, affix the film to the palletized stack, begin the wrap cycle, end the wrap cycle, cut the film, and move the palletized wrapped pallet from the wrap zone into a second staging zone where it can be transferred along down through the distribution channel. Two critical points of this cycle are the affixing of the film to begin the wrap cycle and the cutting of the film to end the wrap cycle. A critical delay in the wrapping process occurs if the film is not in a position for the wrap cycle to begin, which is usually attributable to a failure to leave the film in the proper position at the end of the previous wrap cycle. One embodiment of a prior art device, as exemplified by the Lantech device, utilizes a pincer-type gripper which is typically formed of a set of two pinching jaws located at the low point of the vertical wrapping mechanism travel. This is typically adjacent the level of the pallet as part of the palletized load.

At the beginning of a pallet wrapping cycle, a raw end of film lies adjacent the palletized load which has been recently moved into the wrap zone and in a position for wrapping. This loose or trailing end of film has been severed from the previous stack, by a method to be described later, but has been cut in such a manner so as to allow it to fall within the jaws of the gripping mechanism. As the wrap cycle begins, the gripping mechanism clamps on the film and the film is disposed along the outside of the palletized material. In the example of the Lantech machine, the turntable upon which the pallet is resting begins to revolve while the wrapping mechanism is disposed in a vertical direction to provide a helically wound wrapping layer. This system is, however, just as applicable to mechanisms utilizing a rotary wrapping arm. Once the wrapping procedure is completed and the wrapping mechanism is approaching the home position, the device automatically discontinues the application of prestretch to the film being applied. This allows a section of unstretched film to comprise the terminal portion of the film supply, and provide same as a leading edge to the next cycle. When the swing arm actually comes to the stop position, a cutting armature typically is moved into the wrapping zone adjacent the unstretched film extending between the wrapping mechanism and the palleted material. The cutting armature typically utilizes a heating element of some type to locally melt and sever the film at a particular point. Furthermore, a brush mechanism attached to the cutting armature may be utilized to smooth the recently severed film end along the side of the palleted material. At this time, the free end of the film supply of the wrapping mechanism falls, hopefully into the jaws of the gripping mechanism for the next wrap cycle.

The prior art gripping and cutting mechanism has many limitations and potential areas of failure. More particularly, there are three particular points at which the system may be expected to fail. The first is the failure of the film to fall within the grip of the jaws after the cutting procedure without the ability to grip the film to begin the next wrap cycle. Human intervention is necessary to reset the device at this point and valuable time may be lost. The second potential failure point is the failure of the clamping jaws to retain the film once the wrapping cycle has begun but before the wrap has had an opportunity to establish a grip on the palleted materials. This is typically due to an insufficient grip of the clamping device and more typically because the clamping device has gripped a portion of the film which has been stretched beyond its strength capabilities. The third common potential area of failure is through an insufficient cutting of the film at the termination of the wrap cycle. There are many factors leading to the failure of the film to be completely severed. Most common among these is a contaminated or gummed heating device which is unable to locally melt the film. Typical cutting devices utilize an exposed heated wire or filament for localized melting, which is susceptible to contamination because of its direct contact with the film and the possibility of scrap film adhering thereto. Additional more esoteric problems may include reaction of the film with the heating element or overheating of the cutting element because of film clogging.

What is lacking in the art, therefore, is a device which provides a simple and reliable apparatus and method for efficient gripping and termination of the film load at the beginning and end of each wrap cycle respectively, and one which provides a gripping mechanism which is not dependent upon a fortuitous event such as the landing of the cut film within the jaws; one which allows the gripping device to only grip unstretched film; and finally one which utilizes a cutting device which will reliably perform its cutting operation without risk of contamination in order to provide a consistent, high quality end of the film load.

SUMMARY OF THE INVENTION

A stationary wrapping mechanism is provided which is intended to be utilized in conjunction with an upstream palletizing device and a downstream distribution system. The device is provided with three control zones. The first zone is the inbound zone, the second zone is the wrap zone, and the third zone is the outbound zone. The apparatus is intended to be placed downstream of a palletizing system which allows the passthrough of palletized materials therealong. The inbound zone accepts palletized materials and passes them along to the wrap zone under certain specified conditions. Within the wrap zone, the palleted materials are wrapped to pre-selected specifications with film and are passed along to the outbound zone. The outbound zone provides a direct link with the wrapping device in any downstream distribution conveyor system. It is specifically intended that no human intervention be necessary for the fully-automatic operation of the device after its initial setup. The device is specifically provided with an apparatus for the detection of loads entering the three zones and a method for the continuous pass-through of loads during the entire wrapping cycle.

Control of the device is provided through an operator interface which permits the selection of several operational modes and maintenance operations. Operators may select from a manual mode for movement of the conveyor only, a manual mode to test individual functions of the device under direct operator control, and an automatic mode which provides for continuous of sequential palletized materials without human intervention.

The apparatus provides a relatively short, straight pathway from the point of construction of the loaded pallet through the wrapping station to the outbound conveyor. The structure minimizes the amount and complexity of the travel path of the loaded pallet, while the load stacked thereupon is not yet wrapped and therefore relatively unstable. The device further provides that a variety of differently sized and shaped pallet patterns may be wrapped according to pre-programmed specifications.

An improved swing arm, which provides a rotary mounting means for the film carriage, is of a type generally described in Steding, U.S. Pat. No. 5,140,795. This swing arm is provided to permit increased efficiency with respect to prestretching and wrapping of various stacked loads. A high strength bearing structure, providing high radial and thrust load values, is utilized to permit high wrapping speeds and increased accuracy. The swing arm is adapted to rotate in a circular motion from a pivot point on the mounting frame and encircles the waiting pallet at the wrapping station. It is specifically intended with the use of this device that the pallet remain stationary while the wrapping arm moves circumferentially thereabout rather than utilizing a turntable-type device which might allow load shifting or displacement during the wrapping function.

The wrapping device is provided with a series of sensors and program-controlled drive means in order to detect the presence of palleted loads at the various wrapping stations. In general, a palleted load is directed into the inbound zone from an upstream palletizer and conveyor system. The wrapping device detects the presence of the palleted load moving into the inbound zone and directs the palleted load through the inbound zone into the wrapping zone so long as the wrapping zone is free. If the wrapping zone is occupied, then the palleted load is moved into the inbound zone and retained there until such time as the wrapping zone is free. This is accomplished through the programmed control of motorized conveyors within the inbound zone. Once the wrapping zone has been detected as free through a similar sensing device, the pallet load is moved into the wrapping zone. The device may be utilized to detect the particular size characteristics of the palleted load while the palleted load is entering the wrapping zone and before it is properly located within the specific area intended for the wrapping of the pallet. Otherwise, the device may be programmed to assume the dimensions of the palleted load and wrap it according to pre-selected specifications. In either event, once the device has determined through the use of sensor input that the load is in the correct position, the wrapping sequence is started.

At the beginning of the wrapping sequence, the rotary swing arm is positioned in its home position and the film carriage is positioned such that a free end of film protrudes from the supply roll. This free or leading end is positioned such that it is within the grip range of a gripping device. The gripping device is generally provided as an elongated arm having a coating or brush of material having a high friction coefficient, such as rubber, that may be provided according to any conventional gripping means. The gripping arm is preferably extendable from a home position outside the wrapping area or path of travel of the swing arm. The grip arm extends from outside the path of travel of the swing arm to within this wrapping zone, under program control, in order to press the leading end of the film into direct contact with the frame of the device. The grip arm is specifically designed in an elongated fashion to provide a wide gripping area such that the specific location of the leading end of film is not particularly critical, nor does it need to be positioned within a very specific area. Under program control, the grip arm is extended from without the swing arm radius and optionally with the assistance of a blast of compressed air moves the leading end of film into contact with the frame of the device. Once this has been accomplished, the swing arm begins to rotate around the palleted load drawing the film from the supply roll along the exterior perimeter of the palleted load. Once the swing arm has rotated through a significant portion of its first rotation and the film has gained adherence to the exterior surface of the palleted load, the gripping arm may be retracted at any time. As will be described later, the condition of the leading end of film is an important factor with respect to the consistent success of the gripping function.

The swing arm moves radially about the pallet, distributing prestretched film from the supply carriage through the action of the prestretch rollers and the rotational motion of the swing arm. The load is wrapped according to pre-selected characteristics of top and bottom wraps as well as the amount of prestretch necessary to tightly wrap, but not crush, the load. The wrapping device may further be provided with an optional air delivery system which provides a blast of air directed at the leading end of the film released by the gripping mechanism during wrapping. This permits the tail portion of the leading end of the wrap to be blown within the path of the last revolutions of the wrapping carriage and covered by the last layers of wrap.

At the termination of the wrapping cycle, the swing arm comes to rest at a burn position and a cutting device is extended within the wrapping area, or within the radial movement zone of the swing arm, in order to sever the film on the pallet from the supply roll. The cutting device utilizes a heating element which is preferably enclosed within a housing. The housing is provided with an opening adjacent the position of the heating element, said housing coming into direct contact with a portion of the film between the wrapped palleted load and the supply roll. The film is drawn across the housing and the opening contained therein and is severed by localized melting adjacent the location of the opening in the housing. This localized melting is provided through the radiant heat of the heating element contained within the housing. The utilization of the housing to protect the heating element provides a clean, predictable termination to the film while preventing any direct contact of the melting film material with the heating element itself. This reduces clogging and contamination of the heating element and provides more consistent and long term cutting capabilities of the heating element. As the cutting device comes into contact with the film material and severs it, a brush affixed to the cutting device may be optionally utilized to restrain the trailing end of the film affixed to the pallet from draping outwardly from the palletized load and to press the newly severed trailing end of film against the exterior surface of the palletized load. Because of the prestretched characteristics of the film as well as the residual tackiness of the newly severed trailing end of film of the palletized load, this trailing end adheres to the other film wrapped around the palletized load. This, combined with the wrap of the trailing end, provide a neatly wrapped pallet which is unlikely to become unwrapped by environmental conditions. The swing arm and carriage are then rotated to the home position.

Once the cutting device has retracted itself from the movement zone of the palletized load and the wrapping device has sensed that the outbound conveyor zone is unoccupied, the wrapped palletized load is moved from the wrap zone into the outbound zone. It is optionally provided that the wrapping device may interface with the downstream conveyor system to detect whether or not the downstream conveyor is also unoccupied and to permit the passage of the palletized load from the outbound zone into the downstream conveyor system. Additionally, it may be provided that once the device has moved the wrapped palletized load into the outbound zone, the palletized load is moved automatically into the downstream conveyor system.

These and other advantages and features of the present invention will be more fully understood with reference to the presently preferred embodiments thereof and to the appended drawings.

DESCRIPTION OF THE PREFERRED EMBODIMENTS

Figure 1:
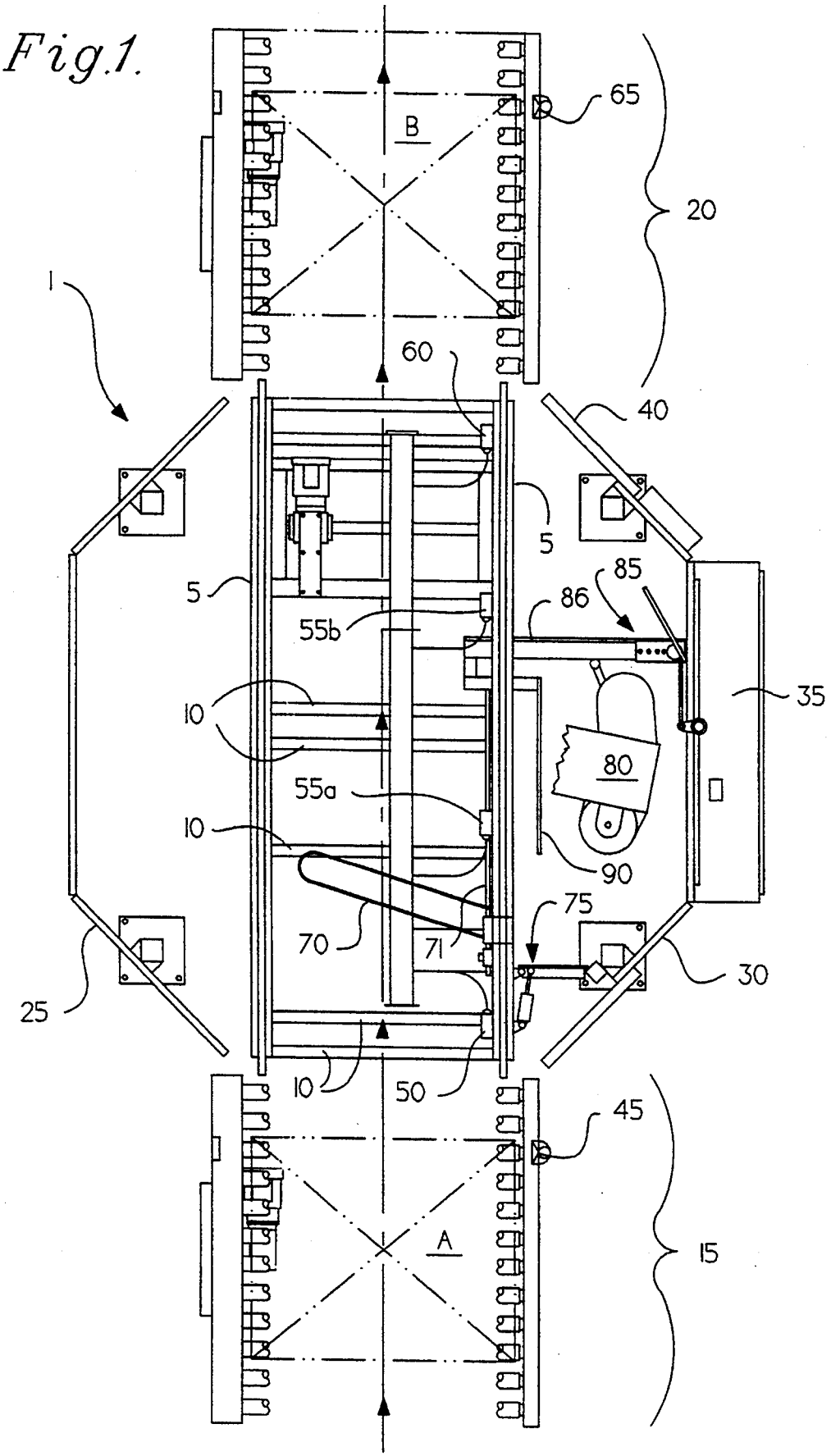
FIG. 1 is a top plan view in partial section of the wrapping mechanism showing the inbound wrap and outbound zones.

Referring to FIG. 1, a stationary pallet wrapper 1 is provided having three basic sections or zones for its operation. These three zones, as viewed from bottom to top, respectively in FIG. 1, are the inbound, wrap, and outbound zones. A pallet of goods is intended to enter the wrapper in the inbound zone, be wrapped within the wrap zone and exit the system through the outbound zone. The movement of this pallet is generally indicated by the arrows located along the centerline of FIG. 1.

Figure 2:
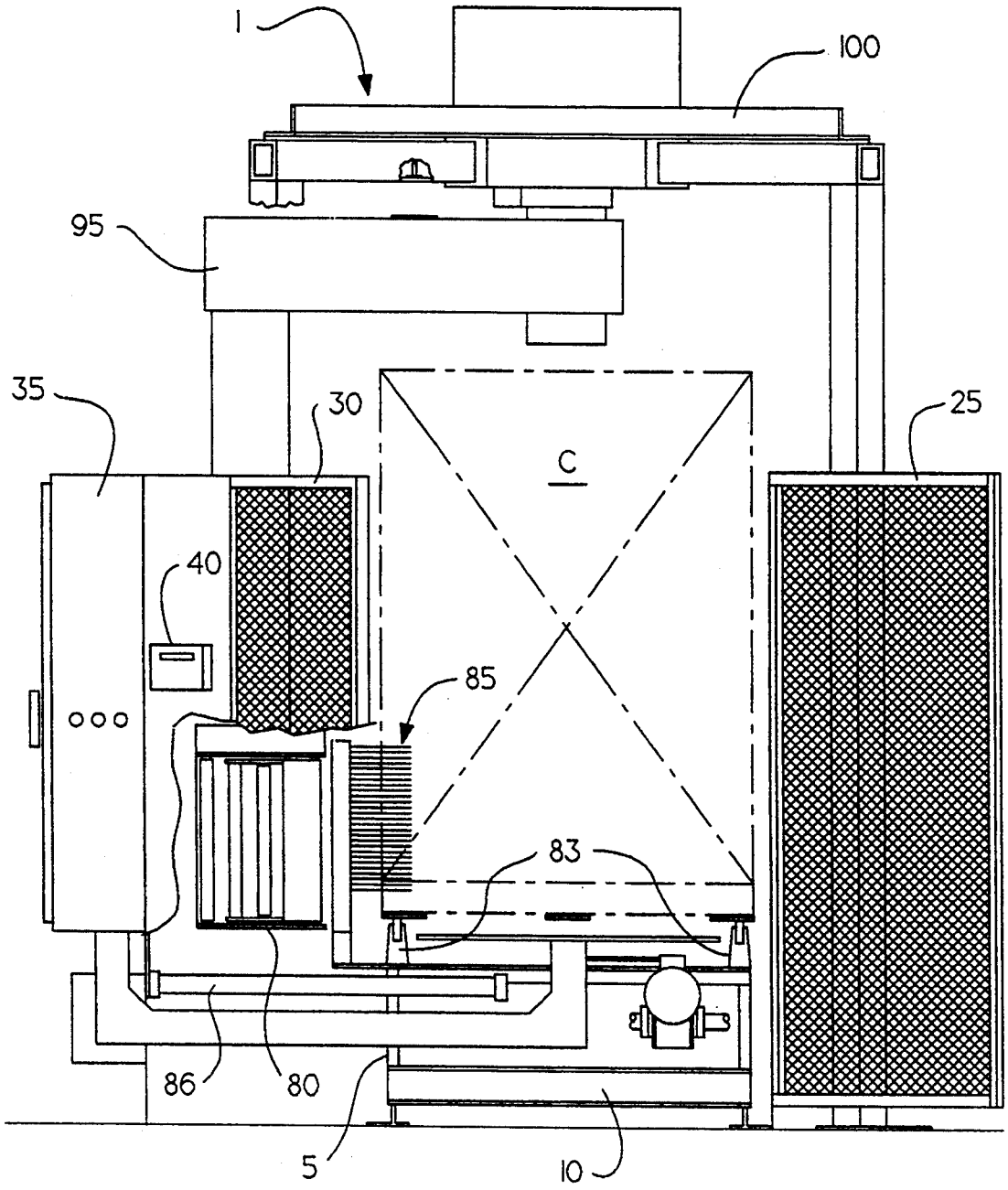
FIG. 2 is a side view in partial section of the wrap zone and the swing arm apparatus.

The wrap zone, which is the central zone of the process and the central portion of the wrapper 1, is generally provided with a wrap zone frame 5 which supports the wrap zone conveyor 83 as shown in FIG. 2, for this central zone. Wrap zone frame 5 supports a plurality of equipment which is conventionally utilized for the operation of a motorized conveyor system such as motors, drive mechanisms, and the like, which are all commonly well-known to those skilled in the art. A series of wrap zone cross members 10 are provided for the support of wrap zone frame 5 and for providing a sturdy support for the pallet which is wrapped within this zone.

The wrap zone conveyor 83, which is supported by wrap zone frame 5, is fed a series of pallets to be wrapped from inbound conveyor 15. Inbound conveyor 15, like that utilized in the central wrapping zone, is of a mechanized variety which is well known to those skilled in the art. Similarly, an outbound conveyor 20 is provided to receive pallets wrapped within the central wrapping zone and to pass those wrapped pallets along to a downstream distribution system. As will be referred to later, a pallet in the inbound zone on inbound conveyor 15 is identified as pallet A, and pallet B is utilized to illustrate one located on the outbound conveyor 20 in the outbound zone prior to passage to the downstream distribution system.

Returning again to the central wrapping zone, the zone and wrapping mechanism contained therein are preferably provided with a fence extending therearound preventing ingress and egress from the wrapping zone during the operation of the wrapping mechanism or at any time the fence is locked. Outer fence 25 is provided merely as a barrier between the central wrapping zone and the remainder of the working environment. Control panel fence 30 is utilized both as a barrier between the mechanism and the remainder of the working environment and as a support for the various control panels and mechanical panels utilized to operate the device. A control panel cabinet 35 is located on control panel fence 30 and contains the various control circuitry and programmable controllers for the system. Control panel 40 is preferably kept in a secure or locked state to prevent unauthorized modification or corruption of the pre-selected operating parameters which control the fully automatic operation of the device. An operator control 40 is mounted upon control panel fence 30 and provides the sole operator access to the mechanical control of the device during its operation. It is specifically intended that the control panel 40 provide the ability for an operator to set up the device or revise its operating parameters but is specifically intended to be unused and unnecessary during the fully automatic operation of the device.

With respect to the movement of a pallet through the stationary pallet wrapper 1, an unwrapped pallet A is moved onto the inbound conveyor 15 into the position illustrated on FIG. 1. Inbound conveyor 15 is provided with inbound pallet detector 45 which is a detecting means of any type well known in the art and is preferably provided as a reflected light beam passed across the path of inbound conveyor 15 such that when a pallet is in position A and breaks the beam of inbound pallet detector 45, the forward motion of inbound conveyor 15 is halted. The central wrapping zone is also provided with at least one detector and is preferably provided with several such detectors to precisely locate a pallet moving through the system and to permit the control means to operate the device in a proper manner, based upon the location of the pallet within the system. Wrap zone inbound detector 50 detects the presence of a pallet moving from the inbound conveyor 15 onto the wrap zone conveyor 83, which is illustrated in FIG. 2. As a pallet passes from the entry of the wrap zone conveyor 83 into the central portion of the wrap zone conveyor 83, its presence is detected by wrap zone location detectors 55. These detectors are utilized to carefully position the pallet to be wrapped at the precise center of the path of travel of the wrapping carriage, as will be described later with reference to FIGS. 2 and 6, and the operation of the device as a whole. Once the pallet has passed through the wrapping stage and has been wrapped, its passage from the wrap zone out to the outbound conveyor 20 is detected by wrap zone outbound detector 60, and its final location as illustrated by pallet B on outbound conveyor 20 is detected by outbound pallet detector 65. The precise application of the detection of the pallet in these various positions will be apparent as described more fully with respect to the operation of the device as a whole.

It is further provided that in a non-automatic mode which may be utilized to move pallets through the system, test the system, or set the system up, all of these operations may be performed manually under complete operator control. Furthermore, the device may be operated such that a pallet may be jogged through the entire system.

Referring again to the central wrapping zone of the stationary pallet wrapper 1, an air vent 70 is provided below the level of the central wrap zone conveyor such that the pallet to be wrapped within the central wrapping zone is passed thereover and is utilized in the incorporation of the leading edge of the film within the wrap, as will be described with more detail in connection with the description of the operation of the device. The air vent 70 which is the termination point of an air delivery system is provided with a supply of air through air supply line 71 and is further provided by an air pump of a type well known to those skilled in the art. A valve system, which is not illustrated within FIG. 1, is utilized to selectively provide a blast of air when called upon by the device through air vent 70. Air vent 70 is provided with a series of perforations along its length which permit the directional flow of air in a controlled fashion and rate.

Stationary pallet wrapper 1 is further provided with a film gripper mechanism 75 which is utilized to grasp the leading edge of the film prior to the wrapping cycle and to retain its grip upon the film until a point subsequent to the initial revolutions of the wrapping carriage about the pallet. This allows the film to be paid out of the supply roll during the wrapping operation. The precise structure of film gripper 75 will be discussed further with reference to FIG. 6.

Swing arm carriage 80 is illustrated within FIG. 1 to provide a sense of scale and the relative location of the path of the wrapping device. Swing arm carriage 80 will be more fully described with respect to FIGS. 3, 4*a* and 4*b*.

A film burn apparatus 85 is provided for the termination of the plastic film following the wrap cycle. Operationally, film burn apparatus 85 is also comprised of film burn apparatus track 86 and film burn assist arm 90. Film burn assist arm 90 is pivotably mounted upon wrap zone frame 5 and is selectively positioned outside the path of the swing arm carriage 80 during its operation. During the cutting of the film at the termination of the wrapping cycle, film burn assist arm 90 is selectively positioned from its horizontal storage position to a vertical operational position adjacent and parallel with the film burn apparatus. A more precise description of the mechanism and operation of the film burn apparatus 85 will be provided with further reference to FIGS. 5*a*, 5*b* and 5*c*.

Referring now to FIG. 2, the stationary pallet wrapper 1 is further provided with swing arm carriage 80 positioned at the terminal end of swing arm 95. The precise operation and structure of swing arm 95 and swing arm 80 will be more fully described with reference to FIGS. 3, 4a and 4b. FIG. 2 illustrates a pallet C positioned on wrap zone conveyor 83 and centrally positioned within the wrap area within the path of swing arm 95 and swing arm carriage 80. Outer fence 25 is positioned at the righthand side of FIG. 2, while control panel fence 30 is provided on the left. Control panel cabinet 35 may optionally be provided with operational controls on its exterior, such as emergency stops and operational lights or indicators of various kinds. Control panel 40 is further illustrated providing a location for operational input as necessary. Film burn apparatus 85 is generally illustrated as being in an engaged position such as would be found at the termination of a wrapping cycle in which the film termination operation is occurring. The film burn apparatus track 86 is provided as a horizontal guideway for the film burn apparatus and permits the longitudinal displacement of the apparatus from without to within the wrapping zone and the path of the swing arm carriage 80 for its operation.

Overhead support frame 100 is utilized to support the swing arm carriage 80 and the swing arm 95.

Figure 3:
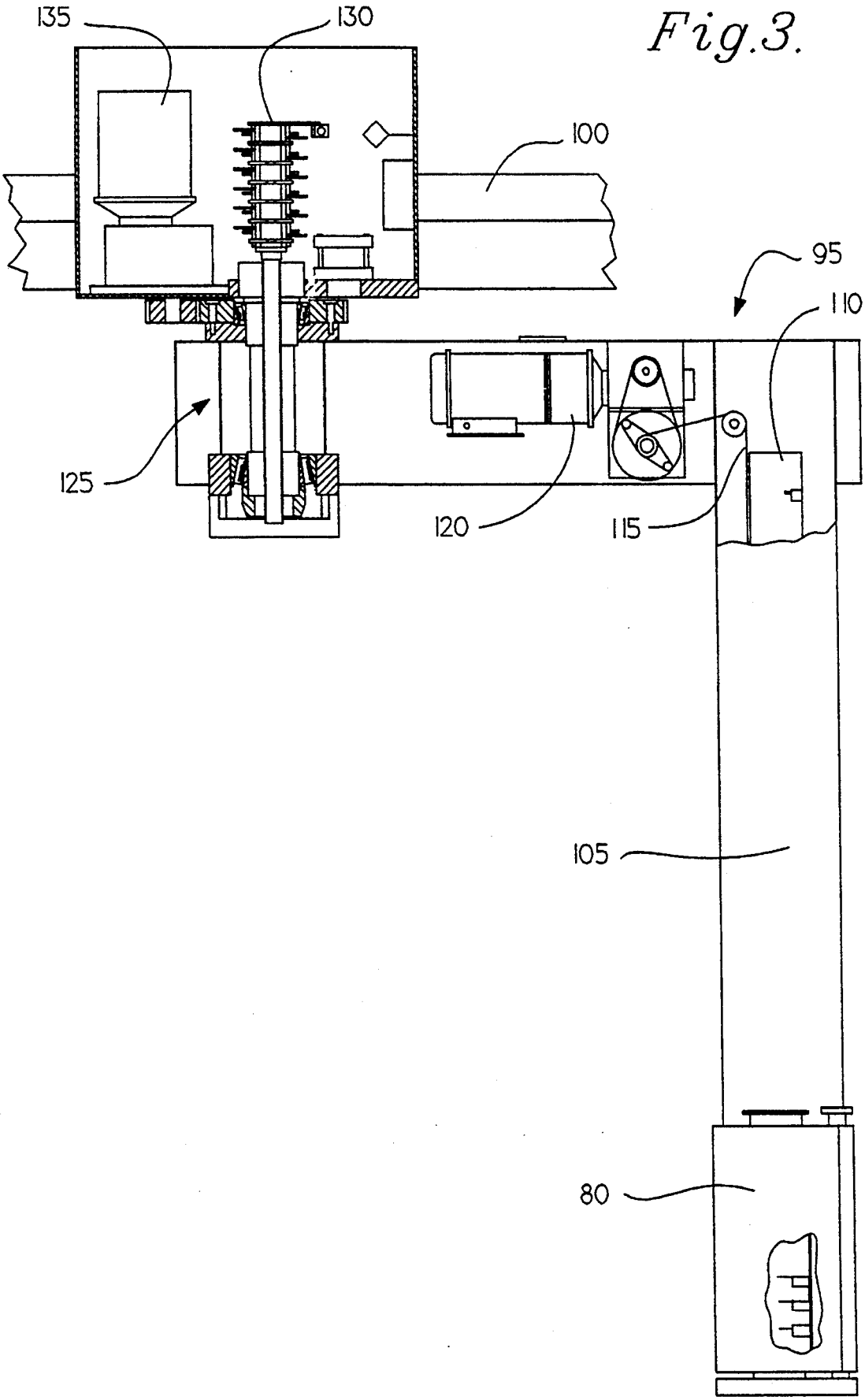
FIG. 3 is a side view in partial section of the swing arm apparatus.

Referring now to FIG. 3, the operation of the swing arm is more fully described. Further reference and description of the operation of the swing arm mechanism may also be found in Steding, U.S. Pat. No. 5,140,795, issued Aug. 25, 1992. Overhead support frame 100 is provided with the swing arm mechanism positioned centrally thereon for even weight distribution and support during the rotational motion of swing arm 95. A pallet is provided centrally within the rotational circular motion of swing arm 95 and swing arm carriage 80, such that an even wrap is applied to the pallet. Swing arm 95 is pivotally connected to the lower portion of overhead support frame 100, and is rotatably displaced by swing arm rotational motor 135. The electronic communication necessary for the transmission of electronic signals to and from the swing arm 95 and swing arm carriage 80 and the central controller unit are provided through slip contact 130 centrally mounted above the rotational point of the swing arm 95. The slip contact 130 permits rotational movement of swing arm 95 while maintaining continuous electrical contact with the remainder of the electrical system of the device. This permits swing arm 95 to continuously rotate without twisting or bending of electrical contact wires which would be needed to be extended from the device to swing arm 95 and swing arm carriage 80. Swing arm 95 is pivotably supported from the overhead support frame 100 and is rotated through the use of swing arm rotational motor 135. This gear-driven system provides a continuous controllable drive for the rotation of the swing arm 95. A braking mechanism of any conventional means may optionally be mounted within the housing of overhead support frame 100 adjacent the swing arm 95, and is adapted to engage and restrain swing arm 95 during an emergency condition or for secure lock-up of the swing arm 95. While swing arm rotational motor 135 and its associated gear-reducing system may be fully adequate to provide the stopping and locating ability necessary for the operation of swing arm 95, the braking mechanism may be optionally utilized.

During the rotational movement of swing arm 95, swing arm carriage support 105 cuts a hollow, cylindrical path around the stacked pallet which is to be wrapped. Swing arm carriage 80 is vertically displaced along swing arm carriage support 105 during the circular movement about swing arm bearing 125. With both circumferential and vertical displacement of the swing arm carriage 80, a helical wrapping pattern is produced on the stacked pallet.

Swing arm carriage 80 is vertically displaced along the length of swing arm carriage support 105 through the use of swing arm carriage lift motor 120, which includes a gear-reducer affixed to a spool containing swing arm carriage lift belt 115. Swing arm carriage lift belt 115 is connected to swing arm carriage lift motor 120 at one end and swing arm carriage 80 at the other. Activation of swing arm carriage lift motor 120 permits the selective upward and downward movement of swing arm carriage 80 along swing arm carriage support 105. The relative speed by which the swing arm carriage 80 is displaced along swing arm carriage support 105 with respect to the rotational speed of swing arm 95 controls the amount of overlap between the helically wrapped layers of stretch wrap about the stacked pallet.

Figure 4A:
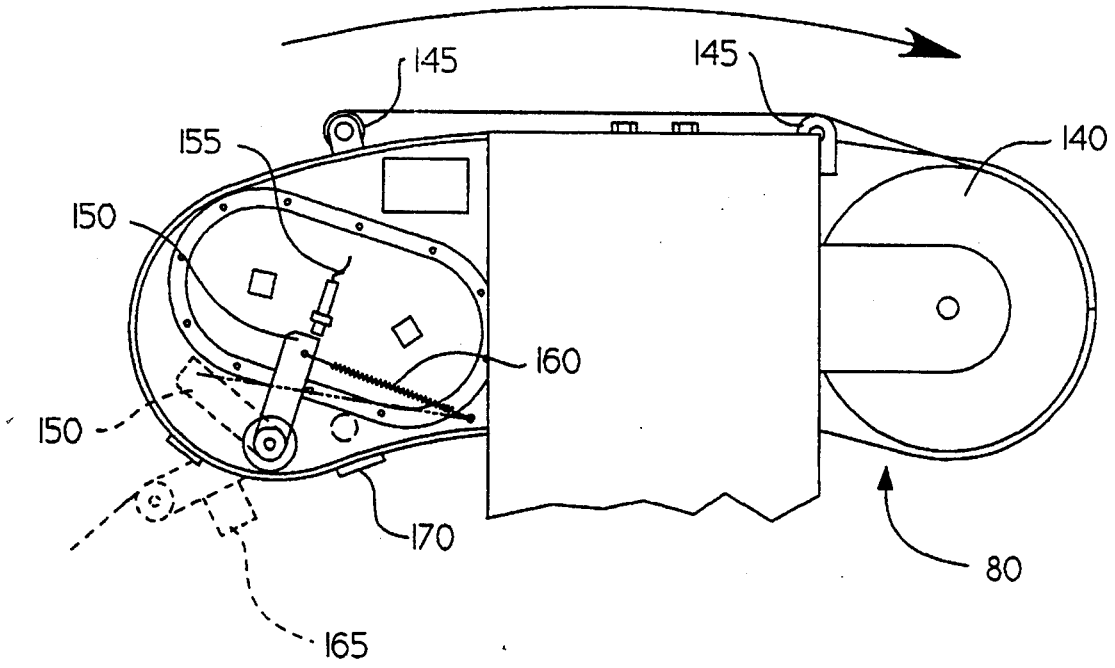
FIG. 4*a* is a top plan view of the film wrapping carriage.
Figure 4B:
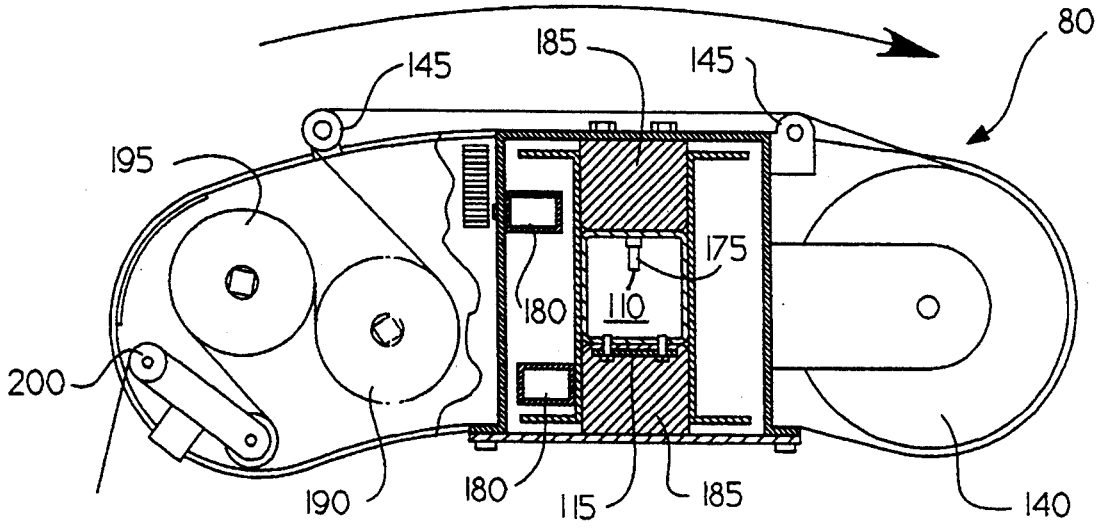
FIG. 4*b* is a top plan view in partial section of the film wrapping carriage.

Referring now to FIGS. 3, 4*a* and 4*b*, swing arm carriage support track 110 extends longitudinally along the center line of swing arm carriage support 105 and provides support for the vertical movement of swing arm carriage 80 in an upward and downward fashion along swing arm carriage support 105. Swing arm carriage 80 is further supported on an adjacent swing arm carriage support track 110 by carriage support blocks 185. These carriage support blocks are preferably comprised on an ultra high molecular weight polyethylene polymer which provides a firm locational base upon which the swing arm carriage 80 may be displaced while further providing a low friction surface which permits the rapid displacement of swing arm carriage 80 along swing arm carriage support track 110. Swing arm carriage lift belt 115 is further mounted to swing arm carriage 80 at a point preferably adjacent swing arm carriage support track 110 and carriage support block 185. Wiring raceways 180 are further provided to permit electrical connection between swing arm 95 and swing arm carriage 80. These wiring raceways are preferably of a flexible or jointed construction which permits the vertical movement of swing arm carriage 80 in an upward and downward fashion along the length of swing arm carriage support 105 without danger of pinching, crimping, twisting or otherwise damaging the wiring.

Swing arm carriage 80 is primarily provided as a receptacle for the retention and feed of a roll of plastic film. Film roll 140 is rotatably mounted upon a housing and passed across guide rollers 145 to the film payout section. The guide rollers 145 define the pathway of the plastic in various directions while maintaining the tension thereon. Two electric motors are utilized to achieve the prestretch of the plastic wrap. These drum motors are well known in the prior art and are exemplified by the Electric GV Drum Motors produced Van der Graaf of DeWeijert, Holland. These drum motors are electrically driven, and the speed by which the external surface turns is controlled electronically from a remote source. The two drum motors may thus be turned independently by controlling the voltages applied thereto. Feeder roller 195 is generally operated at a continuous speed while prestretch roller 190 is utilized to stretch the film between feeder roller 195 and prestretch roller 190 by permitting prestretch roller 190 to turn at a rate slower than feeder roller 195. The film is stretched as it passes between the two roller motors and paid out from feeder roller 195 in a prestretched condition. Dancer roller 200 is utilized to maintain the prestretch along with the tension provided on the film through the movement of the swing arm pulling against the tension of the film connected to the pallet to be wrapped. Thus the differential created between the speeds and the force exerted upon the plastic wrap by the two rollers creates a stretching arrangement, such that the plastic wrap is controllably stretched in a consistent manner.

Tension on dancer roller 200 is laterally displaceable over a small distance permitting a constant amount of tension to be exerted between the plastic wrap emerging from the feeder roller 195 and extending to the stacked pallet. An inductive proximity switch 155 is utilized to detect the proximity of dancer roller support arm 150 within its vicinity. Feedback from the proximity switch 155 is utilized to detect film failure or termination, as will be described with respect to the operation of the device as a whole. Dancer roller tensioning spring 160 is utilized to maintain a constant tension against which dancer roller 200 is pulled against. An optional static eliminator bar 165 may be utilized to reduce static on the prestretched film as it is paid out to the pallet to be wrapped. A top-of-load detector 170 is also located on the movable carriage.

Figure 5A:
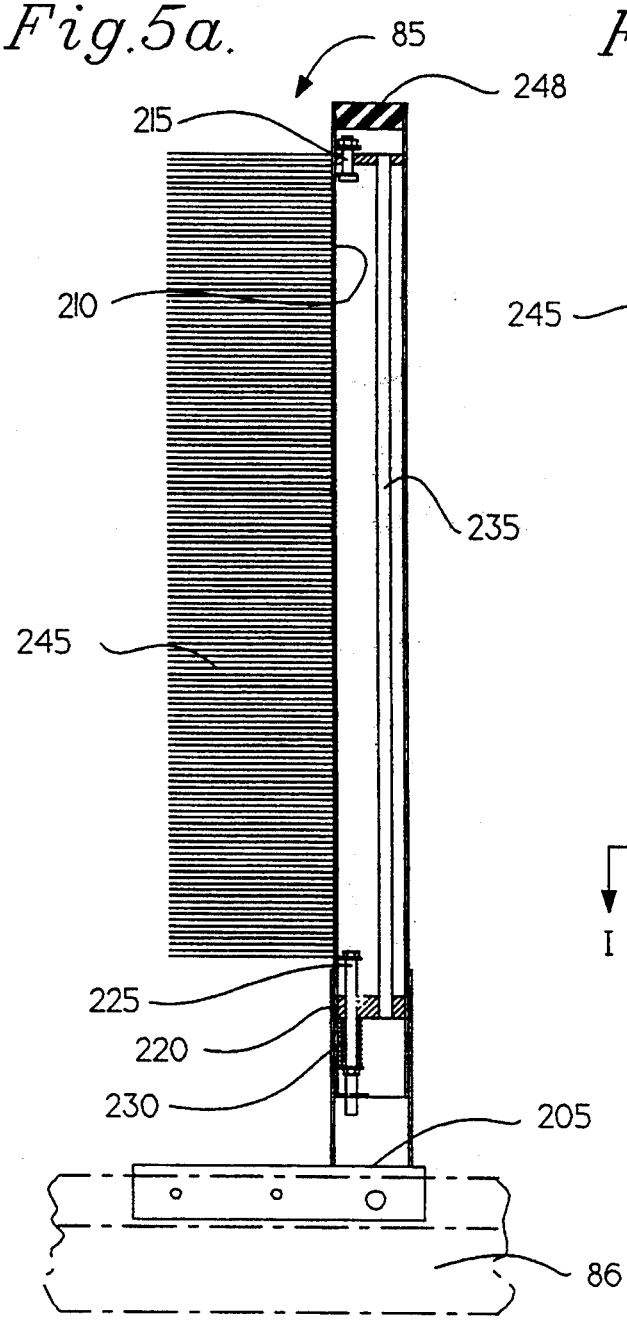
FIG. 5*a* is a side view in partial section of the cutting mechanism.
Figure 5B:
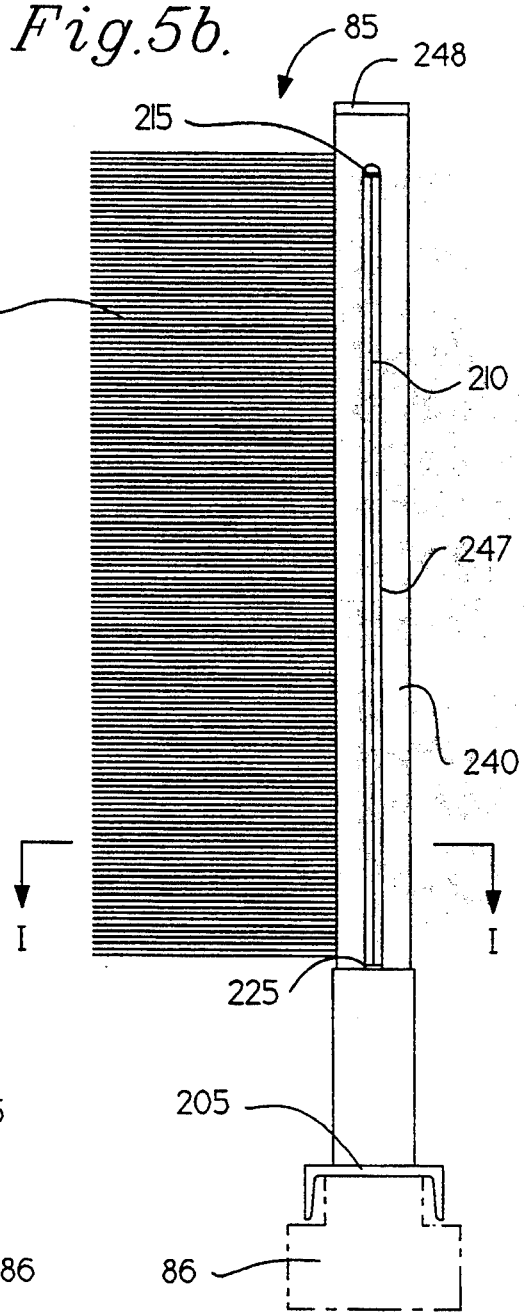
FIG. 5*b* is a side view of the cutting mechanism of FIG. 5*a*.
Figure 5C:
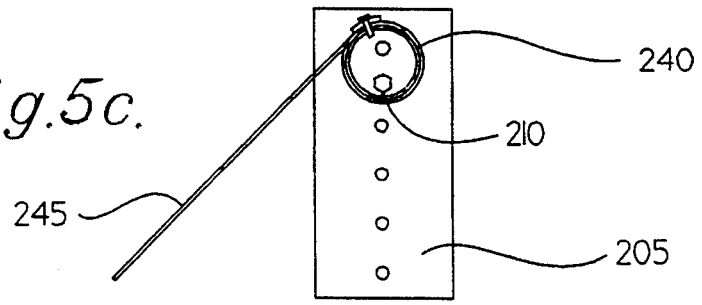
FIG. 5*c* is a top sectional view of FIG. 5*b* taken along line I—I.

Referring now to FIGS. 5*a*, 5*b* and 5*c*, the film burn apparatus 85 is provided with a filament housing 240 which is supported on a burn arm shuttle 205. Burn arm shuttle 205 is horizontally displaced along film burn apparatus track 86. Filament housing 240 is preferably of a circular cross-section and contains heating filament 210 extending along an inner portion thereof. Heating filament 210 is located within filament housing 240 immediately interior to and adjacent slot 247, as may be more particularly viewed in FIG. 5*c*. Heating filament 210 is located such that the radiant heat of the heating filament is dispersed through slot 247 immediately adjacent thereto. Referring again to FIGS. 5*a*, 5*b* and 5*c*, heating filament 210 extends between filament top insulator 215 and filament bottom insulator 220. A wiring housing 235 extends between the top and bottom of the interior portion of filament housing 240 and allows passage of an electric current therethrough to complete the circuit formed by the filament housing by the heating filament 210. A filament tensioner spring 230 is mounted in conjunction with filament bottom insulator 220 to exert a longitudinal force along the length of heating filament 210 and maintaining a constant vertical line along which heating filament 210 lies. Filament tensioner spring 230 also provides some resilience in the event of a snag or other intrusion into the interior space of filament housing 240 by film or the like. A removable cap 248 is optionally utilized at the top portion of filament housing 240 to provide access to filament top insulator 215 and the top portion of wiring housing 235.

Further affixed to filament housing 240 is brush 245. Brush 245 extends tangentially outwardly from a point on the exterior of filament housing 240, preferably at a point diametrically opposite and along a diameter of filament housing 240 from heating filament 210 and slot 247.

Figure 6:
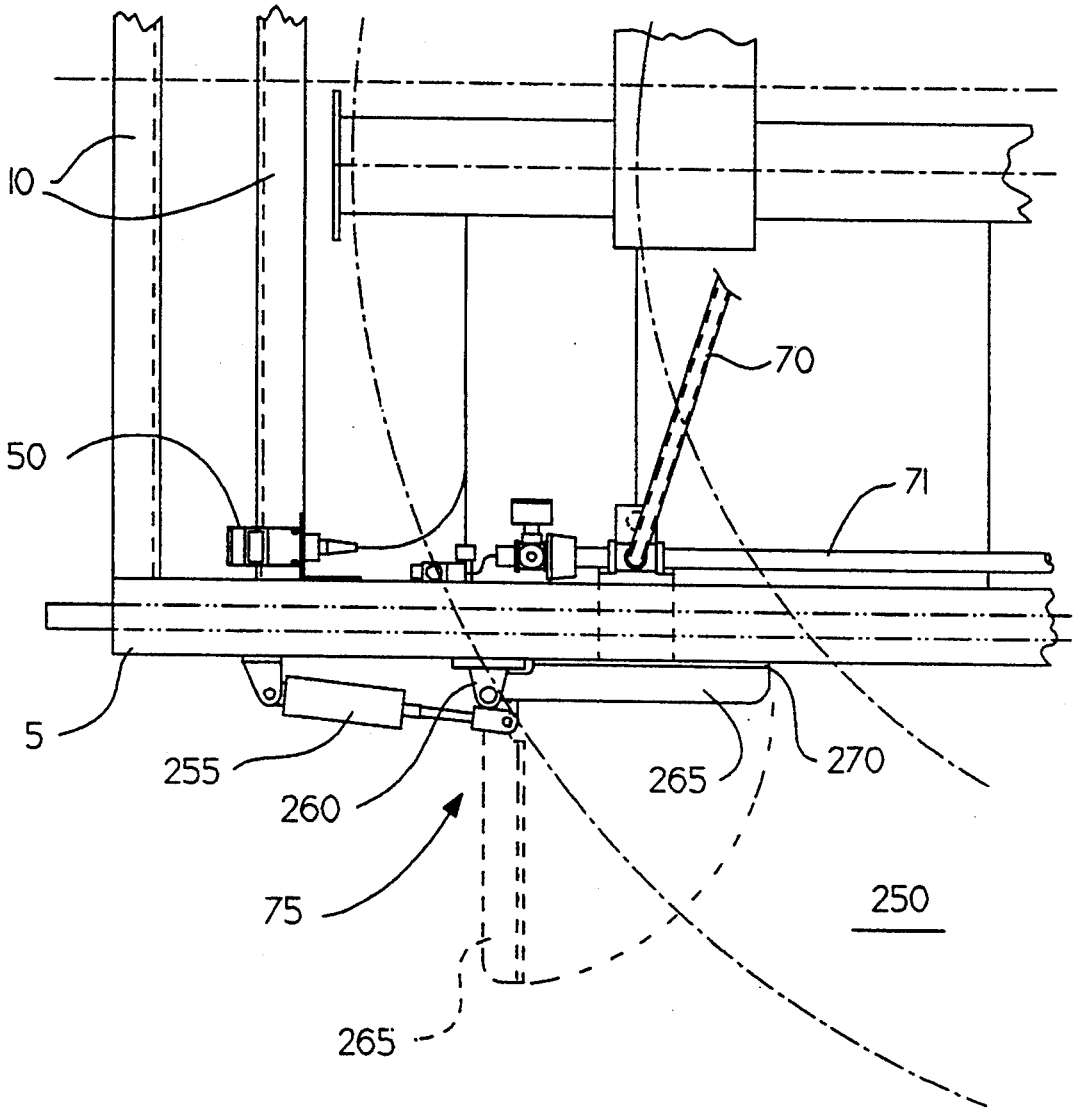
FIG. 6 is a top plan view of the film gripping apparatus.

Referring now to FIG. 6, the film gripper 75 is illustrated as being mounted adjacent to a side edge of wrap zone frame 5 at a position adjacent air vent 70 and air supply line 71.

Referring now to FIGS. 1 and 6, film gripper 75 is positioned such that it is within wrap arm swing zone 250 and it may grip a leading end of film hanging within nearly the entire zone of wrap arm swing zone 250. Film gripper 75 is pivotably mounted to wrap zone frame 5 at two points. Extending therebetween is grip arm control cylinder 255 which is further pivotably mounted to grip arm 265 at grip arm pivot 260. Grip arm 265 is further provided with grip arm insert 270 which is preferably of a high friction material, such as rubber, which facilitates the reception and restraint of a tail end of film between grip arm 265 and wrap zone frame 5. As may be seen with reference to FIG. 6, film gripper 75 may be placed in one of two positions through the operation of grip arm control cylinder 255. When grip arm control cylinder 255 is retracted, grip arm 265 is pivoted about grip arm pivot 260 into a position generally perpendicular to the longitudinal axis of wrap zone frame 5 and is considered to be in a disengaged position. Extension of grip arm control cylinder 255 forces grip arm 265 about the grip arm pivot 260 into an engaged position while immediate adjacent and in contact with wrap zone frame 5 by grip arm insert 270. The operational characteristics of film gripper 75 will be more fully illustrated with reference to the description of the operation of the entire device.

In operation of the stationary pallet wrapping device, all automatic operations are essentially controlled by a central processing unit having a processor and a memory means. These devices are well known in the prior art and are adapted to receive and transmit data to and from detectors and the various mechanical parts according to methods well known in the prior art.

The stationary wrapping device is meant to be operated in three principal modes, the first mode being the manual conveyor mode in which the conveyors may be utilized to move pallets into, through and out of the three zones. In this mode, only the conveyors are operational and the pallet is moved without any wrapping functions.

The second mode of operation is the manual test mode in which the device may be utilized for the function and partial operation of the three zones while testing the wrapping device for pallet wrapping under constant operator control. Each of these two previous modes involve the utilization of the device in a manner consistent with other devices known in the prior art.

In the fully automatic mode, no operator control or supervision is necessary for the continuous operation of the device and for the successive wrapping of numerous pallets. Operator assistance is necessary only in the event of a fault or at the termination of the supply of wrapping film.

In the fully automatic mode, a pallet is passed from an upstream conveyor and/or palletizer onto the inbound conveyor 15 until it reaches position A, as indicated in FIG. 1. Once the pallet has entered the detection zone of inbound pallet detector 45, the inbound conveyor 15 is halted until a permissive signal is received for passage into the central wrapping zone via wrap zone conveyor 83 as shown in FIG. 2. In order for a permissive signal to be received, wrap zone inbound detector 50 must be clear as must wrap zone location detector 55*a*. This indicates that the entry of the wrap zone is clear of a pallet and that a pallet from inbound conveyor 15 may be safely passed into the wrapping zone. The pallet illustrated at a position A is then moved through the activation of inbound conveyor 15 onto wrap zone conveyor 83 and is detected at its entry point by wrap zone inbound detector 50 and the first wrap zone location detector 55*a*. Wrap zone conveyor 83 continues to operate until the pallet has reached a position where both wrap zone location detectors 55 detect its presence and neither wrap zone inbound detector 50 nor wrap zone outbound detector 60 show the presence of a pallet. At this point, wrap zone conveyor 83 is halted with the pallet at the precise center of the wrapping zone. While in this condition or in the condition of any of the wrap zone detectors showing the presence of a pallet, inbound conveyor 15 will hold any incoming pallet at position A.

Once a pallet is located in the zone defined by wrap zone location detectors 55 and both wrap zone inbound detector 50 and wrap zone outbound detector 60 show a clear entry and exit zone for wrap zone conveyor 83, the wrapping process begins. Swing arm carriage 80 begins at its home position, which is at a point immediately adjacent control panel cabinet 35 and perpendicular to the longitudinal path of the conveyors. As the wrap cycle begins, swing arm 95 is rotated in a clockwise fashion, displacing swing arm carriage 80 in the direction towards wrap zone frame 5 immediately adjacent film gripper 75. The movement of swing arm carriage 80 is within wrap arm swing zone 250, as illustrated in FIG. 6. The speed of swing arm carriage 80 is kept at a reasonably slow speed in order for a leading end of film, which is depending from swing arm carriage 80, to be gripped through the action of film gripper 75. As swing arm carriage 80 nears a point of proximity to film gripper 75 and the tail of film is within the gripping zone of film gripper 75, grip arm control cylinder 255 is extended pivoting grip arm 265 about grip arm 260. This is more clearly visualized with reference to FIGS. 1 and 6. The extension of grip arm control cylinder 255 against grip arm 265 and grip arm pivot 260 forces grip arm 265 into a position immediately adjacent wrap zone frame 5 and causing grip arm insert 270 to squeeze and restrain the leading end of film between grip arm insert 270 and wrap zone frame 5.

Swing arm carriage 80 then moves within its clockwise orbit to a position beyond that parallel to the longitudinal line of the wrap zone conveyor 83. At this point if dancer roller 200 and dancer roller support arm 150 are detected as being within proximity of dancer roller proximity switch 155, the device assumes that the film gripper 75 has failed to grip the leading end of the film and returns to the home position for a second attempt. After a failed second attempt, the device emits a warning or other indication of failure that requires operator assistance.

Once film gripper 75 has successfully restrained the leading end of film between grip arm insert 270 and wrap zone frame 5, swing arm 95 and swing arm carriage 80 begin the rotational movement which permits the wrapping of the pallet. Pallet wrapping is accomplished in three sections, being bottom wraps, intermediate wraps and top wraps. These parameters are preselected according to the type of load and merchandise contained on the pallet and are utilized to carefully restrain the palleted merchandise without crushing, as is well known in the prior art.

As swing arm 95 and swing arm carriage 80 approach the end of the total wrapping cycle, but before the last revolution of bottom wrapping occurs, film gripper 75 releases the leading end of film restrained between grip arm insert 270 and wrap zone frame 5 and allows free movement of that leading end. Air vent 70 is then charged with a supply of air through air supply line 71 in a burst such that the leading end of film is propelled upwardly against the external surface of the wrapped pallet. This activity is precisely timed such that swing arm carriage 80 passes adjacent the now vertically oriented film tail adjacent the wrapped pallet such that the passage of the final layer of film from swing arm carriage 80 affixes the tailing end of film to the pallet in such a manner that it does not extend outwardly from the unified wrapped palleted merchandise.

At the conclusion of the wrapping cycle, the swing arm 95 and swing arm carriage 80 approach the home position and a position immediately adjacent the film burn apparatus 85 at a point at which the swing arm carriage 80 passes over the film burn apparatus track 86. Film burn assist arm 90 is moved from a horizontal position immediately adjacent wrap zone frame 5 into a vertical position parallel to filament housing 240 of film burn apparatus 85. At this time, the prestretch parameters of the film are altered such that prestretch roller 190 is increased in its rotational speed relative to feeder roller 195, reducing significantly the amount of prestretch of the film. Once the swing arm 95 and the swing arm carriage 80 have returned to a position near or at the home position immediately adjacent the control panel cabinet 35, burn arm shuttle 205 carrying filament housing 240 is displaced inwardly along film burn apparatus track 86 to a point immediately adjacent the stretched film extending between swing arm carriage 80 and the wrapped pallet. Film burn assist arm 90 is utilized to correctly position the film with respect to the heating filament 210 and to provide a flat, even and aligned surface for the cutting of the film. Filament housing 240 containing heating filament 210 is moved into a position immediately adjacent the stretched film extending between swing arm carriage 80 and the wrapped pallet, which stretches the film across slot 247.

The radiant heat of heating filament 210, which is located adjacent slot 247 and adjacent but not in contact with the film, is sufficient to provide localized melting of the film in relatively straight and even fashion. It is specifically intended that the film be melted at a point at or near the boundary between the prestretched and the nonprestretched film such that the non-prestretched film provides the leading end of film for the next wrapping cycle, and the end of stretched film provides a trailing end to be affixed to the pallet.

Once the film burn is detected by the retraction of dancer roller 200 and the detection by dancer roller proximity switch 155 of dancer roller support arm 150 through the action of dancer roller tensioning spring 160, the wrap cycle is completed and swing arm 95 and swing arm carriage 80 return to the home position immediately adjacent control panel cabinet 35.

Once the wrap cycle is terminated and the swing arm carriage is returned to its home position, the pallet is moved from its home position on wrap zone conveyor 83 to outbound conveyor 20 so long as a permissive signal is present. A permissive signal is present if outbound pallet detector 65 provides a clear signal that no pallet is located in position B as shown in FIG. 1. If a pallet is in position B in FIG. 1 and outbound conveyor 20 is occupied, then the pallet will remain in the wrap zone until such time as the outbound conveyor 20 is cleared. The pallet begins its movement along wrap zone conveyor 83 following the entry of a permissive signal, brush 245 of film burn apparatus 85 is located such that it brushes against the exterior surface of the wrapped pallet immediately adjacent the trailing end of film which has been recently cut by heating filament 210. The brush 245 is utilized to firmly affix the trailing end of film to the exterior of the wrapped pallet in such a manner that no free edge hangs or depends from the pallet. The pallet is then moved past wrap zone location detector 55 and to wrap zone outbound detector 60. If no permissive signal is received, the pallet will remain adjacent wrap zone outbound detector 60. Once a permissive signal is received that the outbound zone is clear, or the conveyor 20 is running, the pallet is moved from wrap zone conveyor 83 onto outbound conveyor 20. Once wrap zone inbound detector 50 and wrap zone location detector **55*a* provide a clear signal, a permissive signal is granted to inbound conveyor 15 to begin the wrap cycle again. It is optionally provided that a signal may be detected from a downstream conveyor system to permit the movement of a pallet in position B as shown in FIG. 1 from the outbound conveyor 20** to a downstream distribution system.

While a present preferred embodiment of the invention is described, it is to be distinctly understood that the invention is not limited thereto but may be otherwise embodied and practiced within the scope of the following claims.

What is claimed is:

1. A fully automatic, stationary pallet wrapping device comprising:

a) an inbound zone having a first conveyor means adapted to selectively and sequentially displace at least one pallet therealong;

b) a wrap zone having a second conveyor means, the second conveyor means positioned immediately adjacent the first conveyor means such that said at least one pallet may selectively and sequentially pass from said first conveyor means to said second conveyor means;

c) an outbound zone having a third conveyor means, said third conveyor means positioned adjacent said second conveyor means such that said at least one pallet may selectively and sequentially pass from said second conveyor means to said third conveyor means;

d) wrapping means positioned adjacent said second conveyor means within said wrap zone, such that said at least one pallet, when located within said wrap zone at a pre-selected position may be sequentially helically wound with a section of film distributed from said wrapping means;

e) gripping means mounted within said wrap zone and associated with said wrapping mechanism, said gripping means located and adapted to grasp and restrain one end of said section of film prior to said winding of said at least one pallet with said section of film; and f) film termination means adapted for selective engagement with and termination of said section of film, said film termination means having a filament cutting element encased within a housing, such that said filament cutting element is spaced apart from said section of film when said film termination means is selectively engaged with said section of film.

2. A pallet wrapping device as described and claimed in claim 1, wherein at least one of said first, second and third conveyor means is a motorized, electronic conveyor, the operation of which may be selectively engaged and discontinued.

3. A pallet wrapping device as described and claimed in claim 2, wherein each of said first, second and third conveyor means are motorized, electronic conveyors, the operation of which may be selectively engaged and discontinued.

4. A pallet wrapping device as described and claimed in claim 1, wherein said inbound zone is provided with a detector adapted to detect the presence of a pallet adjacent thereto within said inbound zone.

5. A pallet wrapping device as described and claimed in claim 4, wherein said inbound zone has an entry and an exit point and said detector is located adjacent the exit point of said inbound zone.

6. A pallet wrapping device as described and claimed in claim 5, wherein said detector is adapted to discontinue the operation of said first conveyor means within said inbound zone when said detector detects the presence of pallet adjacent thereto within the inbound zone.

7. A pallet wrapping device as described and claimed in claim 1, wherein said second conveyor means is provided with at least one detector adapted to detect the presence of a pallet adjacent said at least one detector within said wrap zone.

8. A pallet wrapping device as described and claimed in claim 7, wherein said wrap zone has an entry and an exit point and said at least one detector is located adjacent a wrapping point central to said wrap zone adapted to detect the presence of a pallet located at said wrapping point.

9. A pallet wrapping device as described and claimed in claim 8, wherein said at least one detector is adapted to discontinue the operation of said second conveyor means within said wrap zone when said at least one detector detects the presence of pallet adjacent said at least one detector at said wrapping point.

10. A pallet wrapping device as described and claimed in claim 9, wherein said wrap zone is provided with a plurality of detectors, a first detector located at said entry point of said second conveyor, a second detector located at said exit point of said second conveyor, and a pair of third and fourth spaced apart detectors located adjacent to and equidistant from said wrapping point.

11. A pallet wrapping device as described and claimed in claim 10, wherein said third and fourth detectors are spaced apart and adapted to discontinue the operation of said second conveyor when said detectors detect the presence of a pallet adjacent thereto.

12. A pallet wrapping device as described and claimed in claim 1, wherein said inbound zone is provided with an inbound zone detector, adapted to detect the presence of a pallet adjacent thereto, and said wrap zone is provided with at least one wrap zone detector, adapted to detect the presence of a pallet adjacent thereto, and further adapted to discontinue the operation of said first conveyor when said wrap zone detector detects the presence of a pallet adjacent thereto.

13. A pallet wrapping device as described and claimed in claim 12, wherein said wrap zone is provided with a plurality of detectors, a first detector located at said entry point of said second conveyor, a second detector located at said exit point of said second conveyor, and a pair of third and fourth spaced apart detectors located adjacent to and equidistant from said wrapping point, said wrap zone detectors adapted to discontinue the operation of said first conveyor when said third and fourth detectors detect the presence of a pallet adjacent thereto.

14. A pallet wrapping device as described and claimed in claim 12, wherein said wrap zone is provided with a plurality of detectors, a first detector located at said entry point of said second conveyor, a second detector located at said exit point of said second conveyor, and a pair of third and fourth spaced apart detectors located adjacent to and equidistant from said wrapping point, said wrap zone detectors adapted to engage the operation of said first conveyor when said third and fourth detectors fail to detect the presence of a pallet adjacent thereto.

15. A pallet wrapping device as described and claimed in claim 14, wherein said wrap zone detectors are adapted to engage the operation of said first conveyor when said third and fourth detectors detect the presence of a pallet adjacent thereto and said inbound zone detector detects the presence of a pallet adjacent thereto.

16. A pallet wrapping device as described and claimed in claim 13, wherein said wrap zone detectors are adapted to engage the operation of said wrapping means when said third and fourth detectors detect the presence of a pallet adjacent thereto and said first and second detectors fail to detect the presence of a pallet adjacent thereto.

17. A pallet wrapping device as described and claimed in claim 1, wherein said outbound zone is provided with a detector adapted to detect the presence of a pallet adjacent thereto within said outbound zone.

18. A pallet wrapping device as described and claimed in claim 17, wherein said outbound zone has an entry and an exit point and said detector is located adjacent the exit point of said outbound zone.

19. A pallet wrapping device as described and claimed in claim 18, wherein said detector is adapted to selectively discontinue the operation of said second conveyor means within said wrap zone when said detector detects the presence of pallet adjacent thereto within the outbound zone.

20. A pallet wrapping device as described and claimed in claim 18, wherein said detector is adapted to selectively discontinue the operation of said third conveyor means within said outbound zone when said detector detects the presence of pallet adjacent thereto within the outbound zone and said detector fails to receive an external permissive signal.

21. A pallet wrapping device as described and claimed in claim 1, wherein said wrapping means is further comprised of a swing arm having a horizontal member and a vertical member mounted at one end thereof, said horizontal member rotatably mounted at the other end thereof to a motorized drive means, said swing arm adapted such that said vertical member describes a circular path encircling a pallet placed within the circular path; and wrapping carriage means adapted to contain and selectively and sequentially dispense a section of film, said wrapping carriage slidingly affixed to said vertical member, permitting vertical displacement therealong, said wrapping carriage being vertically and circularly displaced about said pallet to form a helical wrap of film about said pallet.

22. A pallet wrapping device as described and claimed in claim 21, wherein said swing arm further comprises a slip contact for maintaining a plurality of electrical contacts while said swing arm is rotatably displaced.

23. A pallet wrapping device as described and claimed in claim 22, wherein said swing arm further comprises wrapping carriage locator means for vertically displacing said wrapping carriage along said vertical member.

24. A pallet wrapping device as described and claimed in claim 23, wherein said swing arm further comprises at least one wire raceway extending along the length of said vertical member such that said wrapping carriage is continuously in electrical contact with said wrapping means when said wrapping carriage is vertically displaced along said vertical member.

25. A pallet wrapping device as described and claimed in claim 24, wherein said swing arm further comprises a high strength bearing joining said swing arm to said wrapping means, said high strength bearing permitting the rotation of said swing arm with relation to said pallet.

26. A pallet wrapping device as described and claimed in claim 21, wherein said wrapping carriage is comprised of a spool means for storing and dispensing a length of plastic film.

27. A pallet wrapping device as described and claimed in claim 26, wherein said wrapping carriage further comprises two cylindrical speed adjustable rollers.

28. A pallet wrapping device as described and claimed in claim 27, wherein said plastic film passes between said cylindrical speed adjustable rollers, wherein when said cylindrical speed adjustable rollers are rotated at different speeds, said plastic film is stretched therebetween.

29. A pallet wrapping device as described and claimed in claim 28, wherein said speeds of said cylindrical speed adjustable rollers are adjusted according to preset calibrations.

30. A pallet wrapping device as described and claimed in claim 27, wherein said speeds of said cylindrical speed adjustable rollers are adjusted according to the rotational speed of the swing arm.

31. A pallet wrapping device as described and claimed in claim 27, wherein said speeds of said cylindrical speed adjustable rollers are adjusted to achieve a consistent force of said plastic film on said pallet.

32. A pallet wrapping device as described and claimed in claim 27, wherein said wrapping carriage is supported on said vertical member by a series of polymer blocks.

33. A pallet wrapping device as described and claimed in claim 1, wherein said gripping means are further comprised of a first pivot affixed to said second conveyor; a second pivot affixed to said second conveyor, spaced apart from said first pivot; an extendable fluid-operated cylinder pivotably mounted on said first pivot; a grip arm having a high-friction edge thereto, pivotably mounted on said second pivot, said grip arm being further pivotably mounted to said extendable fluid-operated cylinder such that selective extension of said fluid-operated cylinder causes rotational displacement of said grip arm about said second pivot.

34. A pallet wrapping device as described and claimed in claim 33, wherein said gripping means is located adjacent said wrapping means.

35. A pallet wrapping device as described and claimed in claim 34, wherein said wrapping means is further comprised of a rotatably mounted swing arm having a wrapping carriage at one end, said wrapping carriage describing a circular swing zone about said pallet, and said gripping means is located adjacent said swing zone.

36. A pallet wrapping device as described and claimed in claim 35, wherein said grip arm of said gripping means extends adjacent and parallel to said swing zone, said grip arm extending through a majority of said swing zone.

37. A pallet wrapping device as described and claimed in claim 1, wherein said film termination means is further comprised of a track mounted adjacent said second conveyor; a shuttle slidably mounted upon said track; a housing mounted on said shuttle perpendicularly to said track; and heating means, mounted within said housing and extending therealong.

38. A pallet wrapping device as described and claimed in claim 37, wherein said housing further comprises a slot extending longitudinally along its length adjacent said heating means, such that heat emanating from said heating means within said housing may pass through said slot to an area outside said housing.

39. A pallet wrapping device as described and claimed in claim 37, wherein said heating means is a wire filament.

40. A pallet wrapping device as described and claimed in claim 39, wherein said wire filament is stretched adjacent said slot interior to said housing, by a resilient means mounted at one end thereof.

41. A pallet wrapping device as described and claimed in claim 37, wherein said housing has an arcuate face.

42. A pallet wrapping device as described and claimed in claim 37, wherein said housing is circular in cross section.

43. A pallet wrapping device as described and claimed in claim 37, further comprising an assist arm, pivotably mounted to said second conveyer, adjacent said track, selectively positionable in a first and a second position, said first position being horizontal and said second position being vertical, parallel and adjacent to said housing, said first position being an inoperative position, and said second position being adapted to engage a section of film adjacent said housing and to restrain said film in preparation for and during film termination by said heating element.

44. A pallet wrapping device as described and claimed in claim 37, wherein said housing is selectively displaced from a first position to a second position, said first position being an inoperative position, and said second position being adapted to engage a section of film and to locally melt said section of film adjacent said heating element, causing termination of said section of film.

45. A pallet wrapping device as described and claimed in claim 44, wherein said termination means further comprises an assist arm, pivotably mounted to said second conveyer, adjacent said track, selectively positionable in a first and a second position, said first position being horizontal and said second position being vertical, parallel and adjacent to said housing, said first position being an inoperative position, and said second position being adapted to engage a section of film adjacent said housing and to restrain said film in preparation for and during film termination by said heating element, said assist arm being displaced from said first position to said second position when said housing is displaced from said first position to said second position.

46. A pallet wrapping device as described and claimed in claim 37, wherein said film termination means further comprises a brush.

47. A pallet wrapping device as described and claimed in claim 46, wherein said brush is affixed to said housing along a longitudinal axis thereof.

48. A pallet wrapping device as described and claimed in claim 47, wherein said housing comprises a slot extending longitudinally along the length of said housing and said brush is mounted adjacent and parallel to said slot.

49. A pallet wrapping device as described and claimed in claim 1, further comprising an air vent adjacent said wrapping means.

50. A pallet wrapping device as described and claimed in claim 49, wherein said air vent is located in a plane below a plane formed by said second conveyor.

51. A pallet wrapping device as described and claimed in claim 50, wherein said air vent is directed at a pallet located at a wrapping point within the wrap zone.

52. A pallet wrapping device as described and claimed in claim 51, wherein said air vent is located and adapted to displace a leading edge of film extending outwardly from said pallet in an upward direction by expelling a blast of air therefrom directed at said leading edge of film.

53. A method for the sequential, fully automatic wrapping of at least one pallet utilizing a device comprising an inbound zone having a first conveyor means adapted to selectively and sequentially displace at least one pallet therealong; a wrap zone having a second conveyor means, the second conveyor means positioned immediately adjacent the first conveyor means such that said at least one pallet may selectively and sequentially pass from said first conveyor means to said second conveyor means; an outbound zone having a third conveyor means, said third conveyor means positioned adjacent said second conveyor means such that said at least one pallet may selectively and sequentially pass from said second conveyor means to said third conveyor means; wrapping means positioned adjacent said second conveyor means within said wrap zone, such that said at least one pallet, when located within said wrap zone at a pre-selected position may be sequentially helically wound with a section of film distributed from said wrapping means; gripping means mounted within said wrap zone and associated with said wrapping mechanism, said gripping means located and adapted to grasp and restrain one end of said section of film prior to said winding of said at least one pallet with said section of film; and film termination means adapted for selective engagement with and termination of said section of film, said film termination means having a filament cutting element encased within a housing, such that said filament cutting element is spaced apart from said section of film when said film termination means is selectively engaged with said section of film; the method comprising the steps of:

a) moving an unwrapped pallet onto said first conveyor in said inbound zone;
b) detecting the absence of a pallet on said second conveyor in said wrap zone;
c) moving said pallet from said first conveyor in said inbound zone to said second conveyor in said wrap zone;
d) moving said pallet to a wrap point adjacent said wrapping means;
e) engaging and restraining a leading end of said film from said wrapping means with said gripping means;
f) helically wrapping said pallet with said film utilizing said wrapping means;
g) cutting said film wrapped on said pallet from said wrapping means;
h) affixing a tailing end of said film to said wrapped pallet;
i) detecting the absence of a pallet in said outbound zone;
j) moving said pallet from said second conveyor in said wrap zone to said third conveyor in said outbound zone; and
k) moving said pallet from said third conveyor in said outbound zone to a downstream distribution system.

54. A method as described and claimed in claim 53, wherein said pallet is moved onto said first conveyor after a permissive signal is received that said first conveyor is clear.

55. A method as described and claimed in claim 53, wherein said pallet is moved onto said second conveyor after a permissive signal is received that said second conveyor is clear.

56. A method as described and claimed in claim 55, wherein said pallet is moved onto said second conveyor after a permissive signal is received that an entry portion and a wrapping point of said wrap zone are clear.

57. A method as described and claimed in claim 53, wherein said wrapping step is initiated after a permissive signal is received that an entry portion of said wrap zone is clear, and that a wrapping point of said wrap zone is filled.

58. A method as described and claimed in claim 53, wherein said pallet is moved onto said third conveyor after a permissive signal is received that said third conveyor is clear.

59. A method as described and claimed in claim 53, wherein said pallet is moved from said third conveyor to a downstream distribution system after a permissive signal is received that said downstream distribution system is clear.

60. A method as described and claimed in claim 53, wherein said wrapping step includes the rotation of a swing arm and film carriage affixed thereto about the pallet, said film carriage having a leading edge of film protruding thereof, said method having the additional step of utilizing the gripping means to grasp and restrain the leading edge of film at the initiation of the wrapping step.

61. A method as described and claimed in claim 60, wherein said gripping means grasps and restrains said leading edge of film during the movement of said wrapping carriage.

62. A method as described and claimed in claim 61, wherein said wrapping carriage is provided with tension detection means for the measurement of tension on said film, and wherein said tension is tested during the wrapping step.

63. A method as described and claimed in claim 62, wherein said testing of film tension is tested immediately after said gripping means grasps and restrains said leading edge of film, and wherein said wrapping step is aborted if no tension on said film is detected.

64. A method as described and claimed in claim 53, wherein said gripping means releases said leading edge of film during the wrapping step.

65. A method as described and claimed in claim 64, wherein said gripping means releases said leading edge of film at a time point immediately prior to the approach of the wrapping carriage.

66. A method as described and claimed in claim 65, wherein an air vent is located adjacent the location of said leading edge of film, the method comprising the additional step of emitting a blast of air directed at the leading edge of film, causing said leading edge of film to be displaced upwardly and adjacent said pallet, such that said wrapping carriage passes thereover, encasing said leading edge of film under a layer of film.

67. A method as described and claimed in claim 53, wherein said wrapping means further comprises prestretching means for the prestretching of the film prior to its application to the pallet, said prestretching means being adjustable during the operation of the wrapping means, said method comprising the additional step of reducing the prestretching of the film immediately prior to the termination of the wrapping step.

68. A method as described and claimed in claim 53, wherein said film cutting step further comprises the detection of the last revolution of the wrapping means; the reduction of the prestretch of the film; the displacement of the film termination means from an inoperative to an operative position adjacent the path of the film wrapping carriage; the displacement of an assist bar from an inoperative to an operative position adjacent the path of the film wrapping carriage; the engagement of the film termination means to the film extending from the wrapping carriage to the pallet; the localized melting of the film adjacent the film termination means; and the retraction of the film termination means and the assist bar into their respective inoperative positions.

* * * * *

UNITED STATES PATENT AND TRADEMARK OFFICE

CERTIFICATE OF CORRECTION

PATENT NO. : 5,450,709

DATED : September 19, 1995

INVENTOR(S) : Kurt L. Steding

It is certified that error appears in the above-identified patent and that said Letters Patent is hereby corrected as shown below:

On the title page, item [54] and column 1, line 4, change "OR" to --OF--.

Column 4, line 33, before "of sequential" insert -- movement --.

Column 12, line 52, "immediate" should read -- immediately --.

Signed and Sealed this

Nineteenth Day of March, 1996

*Attest:*

Bruce Lehman

BRUCE LEHMAN

*Attesting Officer*

*Commissioner of Patents and Trademarks*